United States Patent [19]

Staude

[11] Patent Number: 4,466,722

[45] Date of Patent: Aug. 21, 1984

[54] FILM DEVELOPING APPARATUS HAVING CONTINUOUS CIRCULATION OF DEVELOPING LIQUIDS

[75] Inventor: Eckhardt Staude, Woelfersheim, Fed. Rep. of Germany

[73] Assignee: Firma Eva Staude, Woelfersheim, Fed. Rep. of Germany

[21] Appl. No.: 425,307

[22] Filed: Sep. 28, 1982

[30] Foreign Application Priority Data

Apr. 10, 1982 [DE] Fed. Rep. of Germany ..... 3213416

[51] Int. Cl.[3] ..... G03D 3/06

[52] U.S. Cl. ..... 354/299; 354/319; 354/325; 134/64 P

[58] Field of Search ..... 354/299, 319, 320, 321, 354/322, 324, 325; 134/64 P, 122 P

[56] References Cited

U.S. PATENT DOCUMENTS

| | | | |
|---|---|---|---|
| 2,177,706 | 11/1939 | Gage | 354/299 |
| 3,372,630 | 3/1968 | Schmidt | 354/321 |
| 3,545,364 | 12/1970 | Reedy | 354/319 |
| 3,635,144 | 1/1972 | Beck | 354/324 |
| 3,688,677 | 9/1972 | Frick et al. | 134/122 P |
| 3,744,394 | 7/1973 | Firth | 354/299 |
| 3,873,988 | 3/1975 | Pfeifer et al. | 354/319 |
| 4,101,919 | 7/1978 | Ammann | 354/319 |
| 4,104,668 | 8/1978 | Laar | 354/299 |
| 4,187,023 | 2/1980 | Schausberger et al. | 354/324 |
| 4,327,988 | 5/1982 | Vanhorebeek et al. | 354/320 |

FOREIGN PATENT DOCUMENTS

| | | | |
|---|---|---|---|
| 2218369 | 11/1973 | Fed. Rep. of Germany | 354/321 |
| 2248538 | 10/1973 | France | 354/299 |

*Primary Examiner*—A. A. Mathews

*Attorney, Agent, or Firm*—Schwartz, Jeffery, Schwaab, Mack, Blumenthal & Koch

[57] ABSTRACT

An apparatus for the development of microfilm passes film successively through different work stations, such as the developer bath, fixing bath, preliminary washing bath, second washing bath and a drying stage. The film moves in a horizontally arranged track with the aid of a motor driven pair of rolls. The apparatus is characterized by a liquid circulation system in which each vessel supplying a liquid station with a liquid and designed as a transport container is equipped with a supply line and a suction line. The suction line moves the liquid to a bath by means of a liquid pump and by way of pressure lines through a heating means. A bath may be associated with each work station. In the bath the liquid is sprayed against the bottom side of the film travelling in the horizontal direction and is returned through a liquid and film guiding body and the supply line into the vessel.

14 Claims, 3 Drawing Figures

FILM DEVELOPING APPARATUS HAVING CONTINUOUS CIRCULATION OF DEVELOPING LIQUIDS

BACKGROUND OF THE INVENTION

1. Field of the Invention

The invention concerns an apparatus for the development of microfilm. More particularly, the apparatus comprises a horizontally arranged track, a plurality of work stations and a drive means. As it proceeds along the track, the exposed film passes successively through different work stations, such as the developer bath, fixing bath, preliminary wash, second wash and then to a drying stage.

2. Background of the Prior Art

An apparatus for the development of microfilm is known in West German Pat. No. 22 18 369, wherein the film to be developed passes over a track consisting of guide rolls and in which the roller track is equipped with additional guide and reversing rolls. The film passes into a closed conveyor consisting of an endless driven belted roller conveyor. The conveyor has a specially reinforced synthetic plastic belt resistant to chemicals, or the like. The film to be developed is fastened to the conveyor at the inlet of the developer bath and released from it prior to the winding of the developed and dried, finished film. The microfilm to be treated passes in the course of the process through the individual baths, wherein the liquids wet the microfilm on both sides. The conveyor belt is mounted, together with all of the rolls, the drive and the unwinding and winding bearings for the microfilm on a frame. The conveyor belt may be inserted with said frame into the individual baths or work stations and removed from them. Due to this measure, the developing apparatus may be dismantled in a simple manner, so that the individual baths or work stations and the conveyor installations may be cleaned and fresh bath liquids added. In addition to the fact that the configuration of the roll system is expensive and that special cleaning is required following the working sequence, the individual bath liquids must be changed and the baths cleaned. Special vessels are necessary for the removal of used liquids and similarly, the fresh and unused liquids must be transported and stored in their own containers.

SUMMARY OF THE INVENTION

It is the object of the invention to simplify the film transport system within a developing apparatus to improve the circulation of the fresh and unused liquids and to improve the removal procedure for the used liquids to be removed. The removal procedure is simplified such that one-half of the number of transport vessels may be eliminated. It is a further object of the invention to reduce the dimensions of the baths of the individual work stations and to make the consumption of chemicals more efficient.

These and other objects of the invention are attained by an apparatus comprising a liquid circulation system having a plurality of work stations, each work station having a vessel supplying a liquid and being designed as a transport container, a supply line and a suction line for each station and a liquid pump and heating means associated with the supply lines. The various liquids flow through the respective lines to a bath of the associated work station, wherein the liquid is sprayed against the horizontal bottom side of the film and returns through a liquid and film guide body and the supply line into the vessel. As the result of this measure according to the invention, the vessel is serving simultaneously as the transport container for the liquid involved and as a storage and supply tank within the circulation for the bath concerned of the work station.

In a preferred embodiment, four work stations having baths are provided. The suction lines are passed preferably through a pump equipped with four suction and pressure chambers. In this manner, it is assured that the same volume of liquid is flowing in unit time through each of the baths.

In a preferred embodiment of the invention, the heating means are in the form of a heat exchanger, comprising in a compartment filled with quartz sand and enclosed by a jacket, a centrally located, electrically operated heating rod extending in the axial direction and surrounded by the pressure lines. This measure insures the uniform heating of all of the baths so that the liquids of all of the work stations are at the same operating temperature. It is of advantage to regulate the heat output of the heating rod by equipping the pressure line supplying the first work stations with a temperature control. The latter is connected with a temperature sensor and the regulation of the heat output in keeping with the temperature values determined insures the supply of the same amount of heat to the remaining pressure lines.

According to the invention, a motor driven pair of rolls for the transport of the film is arranged in front of the first work station so that the need for an expensive and complex roll system is eliminated.

BRIEF DESCRIPTION OF THE DRAWINGS

The invention shall be explained in more detail with the aid of an embodiment shown in the drawings. In the drawings.

DETAILED DESCRIPTION OF PREFERRED EMBODIMENT

Figure 1:
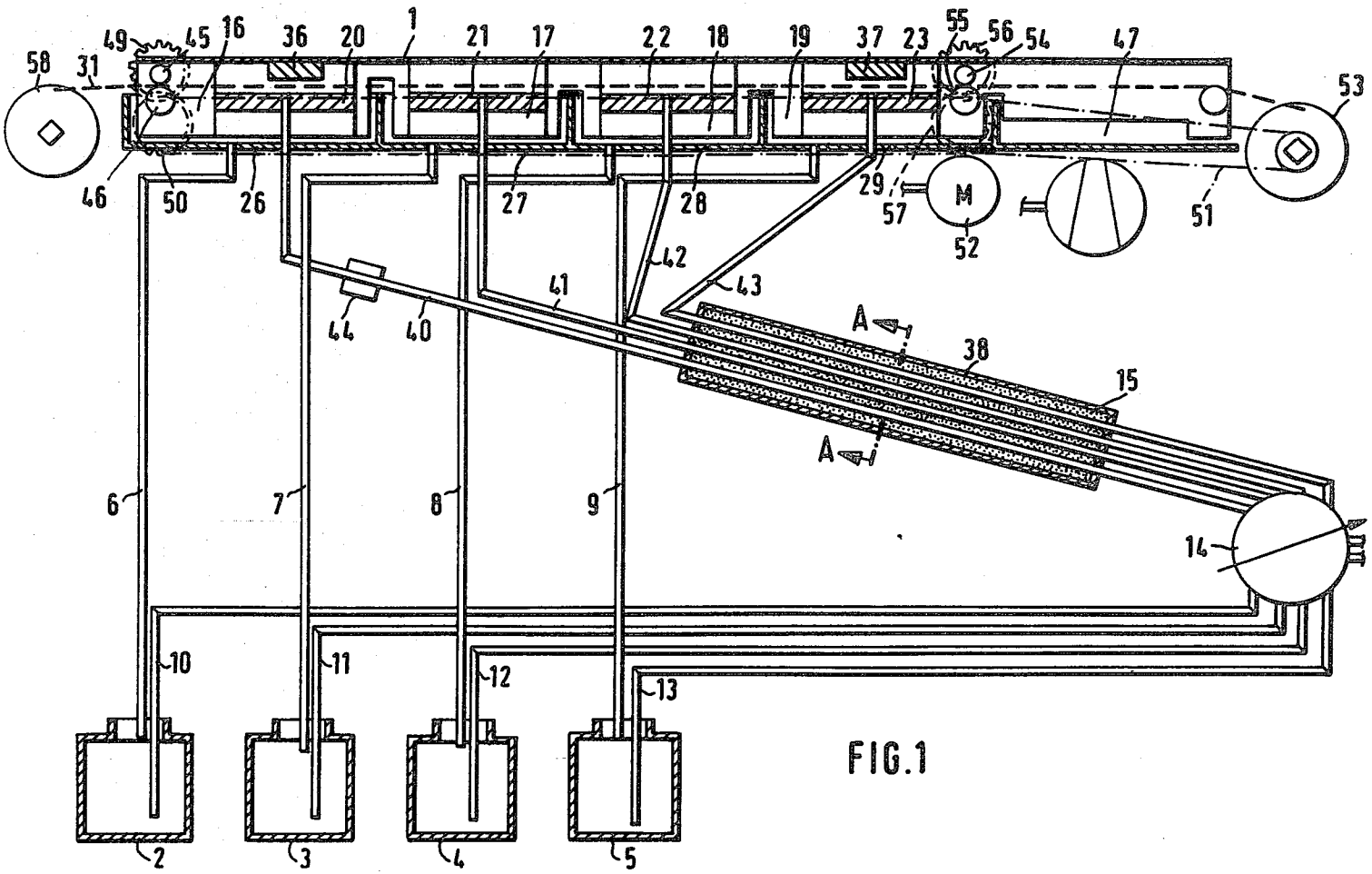
FIG. 1 shows a schematic representation of the liquid circulation within the apparatus as well as the individual work stations of the apparatus.

The apparatus shown in FIG. 1 is located in a housing, not shown in detail, the front cover flap of which, in the open state, reveals the vessels 2, 3, 4 and 5. The vessels 2 to 5 are in the form of containers closed by a screw lid (not shown). The vessel 2 serves to supply the work station 16 with developer solution and the vessel 3 contains a fixing solution to supply the work station 17. The vessels 4 and 5 are supplying the work stations 18 and 19, which effect the preliminary and second washing and contain suitable washing means. Each vessel 2 to 5 is connected with a corresponding suction line 10, 11, 12 and 13. The suction lines lead to a liquid pump 14 which has four suction and four pressure chambers. The lines 40, 41, 42 and 43, extending on the pressure side of the liquid pump 14 pass through heating means 15, which is explained hereinafter in connection with FIG. 2. The individual work stations 16, 17, 18 and 19 are fundamentally similar in their configuration, with the exception of an upper transverse ledge, which again, shall be explained in detail hereinbelow, so that it is sufficient for an understanding of the apparatus to describe the work station 16 in detail as an example. FIG. 3 is used simultaneously for this purpose. All of the work stations, including the drying station 47, are covered by a removable cover part 1 during the operation. Within the bath of the work station 16 (and within the baths of the work stations 17, 18, 19) a liquid and film guide body 20 is arranged. The body 20 has an H-shaped cross section as illustrated in FIG. 3. The vertical supports 24 and 25 of the H-shaped body rest on the bottom 26 of the bath of the work station 16.

The distance of the vertical supports 24 and 25 from one another is slightly smaller than the width of the film 31 (see FIG. 3). For the guidance of the film between the vertical supports 24 and 25, grooves 33 and 34 are provided. The grooves are located above the transverse member 32 of the H-shaped body and extend in the longitudinal direction. The transverse member 32 is equipped with a center bore 35 directed onto the surface of the film and connected with the pressure line 40. The length of the liquid and film-guide body 20 is less than the length of the bath of work station 16, so that the developer solution sprayed from the bore or nozzle 35 onto the transverse member 32 flows onto the bottom 26 of the bath and exits the bath through the supply line 6 which is connected with the vessel 2. As the length of the liquid and film-guide body is less than the longitudinal dimension of the baths, the film is entirely free between the individual baths, so that there is no entrainment of liquids from one bath to the next one. The grooves 33 and 34 in the vertical supports 24 and 25 are dimensioned so that the film 31 is allowed an adequate measure of clearance. The film 31 is guided at an approximate distance of 2 to 3 mm above the transverse member 32, so that a very small space is present for the flow of the liquid. In this manner, the underside of the film is brought into intensive contact with the developer solution.

In certain special cases, it is necessary to also contact the top side of the film with the developer solution and a wash liquid. For this reason, an upper transverse ledge 36, 37 is located in work stations 16 and 19 between the vertical supports 24 and 25.

The upper transversed edges 36 and 37 are located additionally above the film guide grooves 33 and 34. In front of the first work station 16 a motor driven roll pair 45 and 46 is provided for the transport of the film. The rolls 45 and 46 are driven through gear wheels 49 and 50 with the aid of a transmission 51 by the motor 52. The transmission 51 further actuates the film winding roll 53 and two drying rolls 54 and 55 by means of their gear wheels 56 and 57. The film reel 58 requires no drive, as the pair of rolls 45 and 46 is unwinding the film from the roll 58 and moves it through the film guiding grooves 33 and 34.

Figure 2:
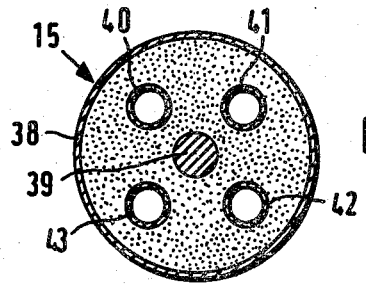
FIG. 2 shows a cross section through the heating device.
Figure 3:
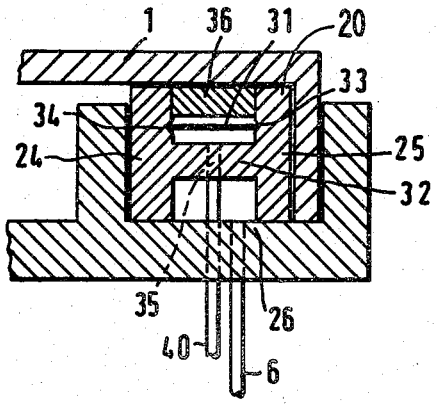
FIG. 3 provides a slightly enlarged view of a liquid and film guide body.

The heating device 15 in FIG. 2 consists of an electric heating rod 39, surrounded in a spaced apart manner by the pressure lines 40, 41, 42 and 43. This space is filled with quartz sand and surrounded by the jacket 38. The pressure line 40 is connected with a temperature control 44, which regulates the heat output of the electric heating rod 39 by means of an electronic circuit.

To activate the apparatus, the liquid pump 14 and the heating device 15 are actuated so that a continuous liquid circulation is effected even before the film has entered the apparatus. As soon as the necessary temperature of the liquids is attained, the motor 52 is actuated and the film 31 fed to the rolls 45 and 46, which seize it and guide it through the film guide grooves 33 and 34 of all of the liquid and film guiding bodies 20 to 23. When the film arrives in the liquid and film guiding body 20, it intersects the flow of liquid spray, while the transverse ledge 36 insures the formation of a liquid compartment even above the film. As the film 31 has an adequate clearance in the grooves 33 and 34, capillary action causes the formation of a flow of sufficient magnitude renewing the liquid. As mentioned hereinabove, the upper transverse ledges 36 and 37 must be provided only if the upper side of the film is to be treated with the liquids. Otherwise, the upper ledges may be eliminated.

The vessels 2, 3, 4 and 5 perform three different functions. They serve to transport the liquid that is still fresh from a storage tank within the apparatus which is included in the circulation system for the liquid involved and further, they remove the used liquid. Compared with the installations known heretofore, one-half of the number of vessels is thus eliminated. No cumbersome cleaning of the storage tank is necessary. Within the work stations, an advantage is obtained in that, as the result of the intensive flow of the circulation, the vessels may be kept relatively small without any reduction in the quality of film development. Overall, this results in the advantage that the apparatus of the invention may be used not only in conventional laboratories, but also in other rooms. For example, rooms which are not equipped with the special facilities usually found in laboratories are suitable because contamination in the cleaning processes is essentially eliminated.

The above description describes a preferred embodiment of the invention. It is to be understood however, that the invention is not limited to any single embodiment or feature, but should be construed to cover all modifications and alternative embodiments falling within the scope of the invention as defined by the claims which follow.

What is claimed is:

1. An apparatus for the development of microfilm comprising:

a plurality of work stations arranged along a work path;

a horizontal track for transporting film along the work path;

means for moving said film in said horizontal track said means including a plurality of rollers and a drive motor;

a plurality of fluid flow circuits each circuit comprising a fluid holding vessel, a suction line, means for providing suction in said suction line, a pressure line, means for providing pressure in said pressure line, means for heating said pressure line, a bath disposed in at least one of said work stations, means for spraying said film in said bath, a liquid and film guiding body in said bath and return conduit from said bath to said fluid holding vessel.

2. The apparatus for developing microfilm of claim 1, wherein said work stations comprise a developing station, a fixing station, two washing stations and a drying station.

3. The apparatus for developing microfilm of claim 2, wherein a separate fluid flow circuit communicates with each of said developing, fixing and washing stations.

4. The apparatus for developing microfilm of claim 3, wherein said means for providing suction and said means for providing pressure comprises a fluid pump connecting said suction and said pressure lines.

5. The apparatus for developing microfilm of claim 4, wherein said means for heating said pressure line comprises a housing, a quartz sand compartment in said housing, a heat exchanger disposed in said compartment, a heating rod centrally located in said housing and said pressure line extending through said housing.

6. The apparatus for developing microfilm of claim 5, wherein said means for spraying said film comprises a spray nozzle located below the film moving in said horizontal track.

7. The apparatus for developing microfilm of claim 6, wherein said fluid pump is independently connected to each of said suction and pressure lines.

8. The apparatus for developing microfilm of claim 7, wherein said heating means comprises each of said pressure lines extending through said housing.

9. The apparatus for developing microfilm of claim 8, wherein said liquid and film guide body comprises an H-shaped member, the upper extending members supporting guides for said film, the lower extending members supporting said spray nozzle.

10. The apparatus for developing microfilm of claim 9, wherein the distance of said upper extending members of said H-shaped member is slightly smaller than the width of said film.

11. The apparatus for developing microfilm of claim 10, wherein said liquid and film guide body is of a length which is always smaller than the length of the bath in the work station.

12. The apparatus for developing microfilm of claim 11, further comprising an upper transverse member in each of said developing bath and second washing bath disposed above said horizontal track and a spray nozzle in each upper transverse member for spraying said film.

13. The apparatus for developing microfilm of claim 12, wherein one of said lines has a temperature control means for regulation of the heat output of said heating rod.

14. The apparatus for developing microfilm of claim 13, wherein said motor and rollers are arranged in front of the first work station for the transport of the film.

* * * * *